United States Patent [19]

Doiron

[11] Patent Number: 4,604,932

[45] Date of Patent: Aug. 12, 1986

[54] SAFETY CHAIN FOR CHAIN SAWS

[75] Inventor: Gerald J. Doiron, Harwich, Mass.

[73] Assignee: Omark Industries, Inc., Portland, Oreg.

[21] Appl. No.: 720,292

[22] Filed: Apr. 5, 1985

Related U.S. Application Data

[63] Continuation of Ser. No. 544,783, Oct. 24, 1983, abandoned.

[51] Int. Cl.[4] ..... B27B 33/14

[52] U.S. Cl. ..... 83/830; 30/382; 83/834; 83/DIG. 1

[58] Field of Search ..... 83/830, 834, 833, 814, 83/544, DIG. 1; 30/381, 382

[56] References Cited

U.S. PATENT DOCUMENTS

| | | | |
|---|---|---|---|
| 3,224,476 | 12/1965 | Chadwick | 83/834 |
| 3,543,817 | 12/1970 | Anderson | 83/833 |
| 4,074,604 | 2/1978 | Goldblatt et al. | 83/830 |
| 4,269,100 | 5/1981 | Deelman et al. | 83/834 |
| 4,425,830 | 1/1984 | Atkinson | 83/833 |
| 4,430,795 | 2/1984 | Wetzel et al. | 30/382 |

*Primary Examiner*—Frank T. Yost

*Attorney, Agent, or Firm*—John W. Stuart

[57] ABSTRACT

A cutting chain for a chain saw including a safety element in front of a cutter tooth, the safety element normally extending past the cutter tooth to inhibit cutting, but depressible by a solid object such as wood to allow cutting.

15 Claims, 7 Drawing Figures

SAFETY CHAIN FOR CHAIN SAWS

This is a continuation of application U.S. Ser. No. 544,783, filed Oct. 24, 1983, (now abandoned).

BACKGROUND AND SUMMARY OF THE INVENTION

Chain saws energized by fossil fuel and electricity have been known for many years. They have been greatly improved and varied in size and horsepower through the years. Many users are amateurs and the chain saw can be a dangerous mechanism. Any provision for rendering the chain saw less harmful is obviously an important step forward in the art.

It is an object of this invention to provide, in the cutting chain itself, an improvement wherein the chain will cut a solid substance (e.g. wood) as usual, but without any attention on the part of the user, will minimize its tendency to cut soft tissue (such as flesh). The safety feature is built directly into the chain.

Articulated chain for a chain saw generally includes a plurality of successive links which are pivotally interconnected to allow them to ride first on a relatively flat, or straight, portion of a cutter guide bar, around a curved end of the bar, and then along another relatively flat, or straight, portion of the bar. The links include cutter teeth which project outwardly a preselected distance from the bar to cut material. Generally a depth gauge, or safety element, leads each cutter tooth and projects outwardly from the bar a distance somewhat less than the distance of the cutter tooth to limit the depth of cut taken by the cutter tooth.

A general object of the present invention is to provide a saw chain which is so constructed that when the chain is running on the generally flat, or straight, part of the bar, the safety element, or depth gauge, projects outwardly from the bar a distance greater than the cutter tooth when the chain is not in engagement with hard material (such as wood to be cut), but is able to be urged inwardly toward the bar to expose the cutting edge of the cutting tooth for cutting as the chain is pressed against the hard material. In this way the chain provides a safety feature whereby soft tissue or material, such as flesh, will be protected if it comes in contact with the chain since it will not overcome the force required to press the safety element down toward the bar, whereas on operation to cut harder materials, such as wood, it can be pressed toward the bar to expose the cutting edge.

More specifically, an object of the invention is to provide safety chain in which a cutter element has forward and rearward pivot connections and is so constructed that when the chain is tensioned (as occurs when the chain is driven around the bar), and running along the flat portion of the bar without pressing against a hard material, and the pivot connections are substantially in line, the underside of a forward portion of the cutter is spaced from the bar and the safety element, or depth gauge, associated with the forward end of the cutter is held at its higher position. When the chain is pressed against a harder material to be cut, the depth gauge is pressed toward the bar to expose the cutter.

An object of the present invention thus is to provide a novel safety chain which is constructed to minimize its tendency to cut softer material, such as flesh, but is operable when pressed against harder material to provide effective cutting of such harder material.

PREFERRED EMBODIMENT OF THE INVENTION

Figure 1:
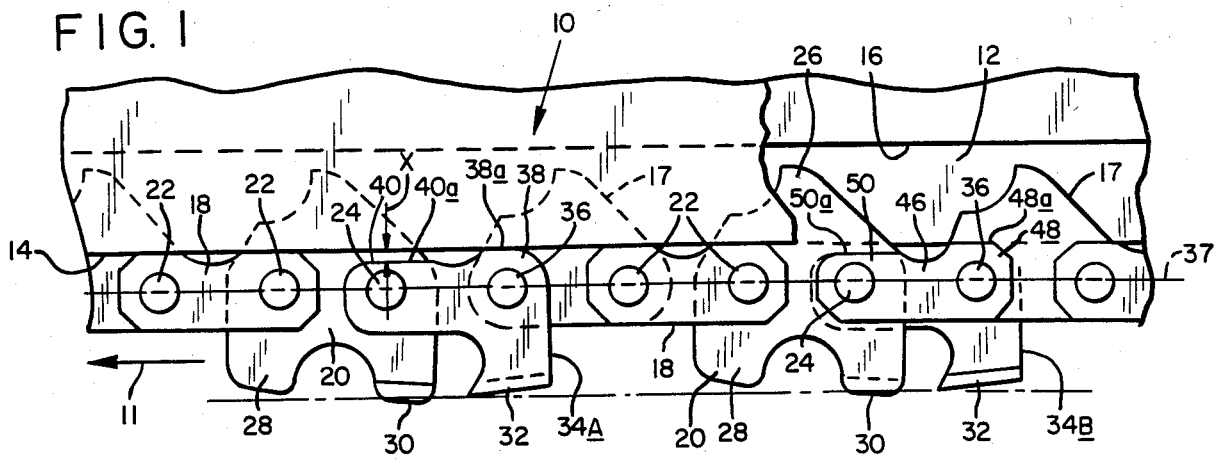
FIG. 1 is an elevation view of a portion of a saw chain constructed according to an embodiment of the invention with elements thereof in safety position.

Describing an embodiment of the invention as illustrated in the drawings, the usual chain saw blade, or cutter bar, is indicated at 10. Only a small portion of the bar is illustrated here, but it will be recognized that such generally is a substantially planar element which projects forwardly from a motor head which drives the chain. The bar would have substantially straight, or flat, upper and lower margins and a curved nose section. The chain on being driven about the bar moves first along one of the straight sides, then around the curved nose portion, and then along the opposite straight side. The direction of travel of the chain is indicated by arrow 11. While driven along the bar, the chain is generally in tension.

Figure 2:
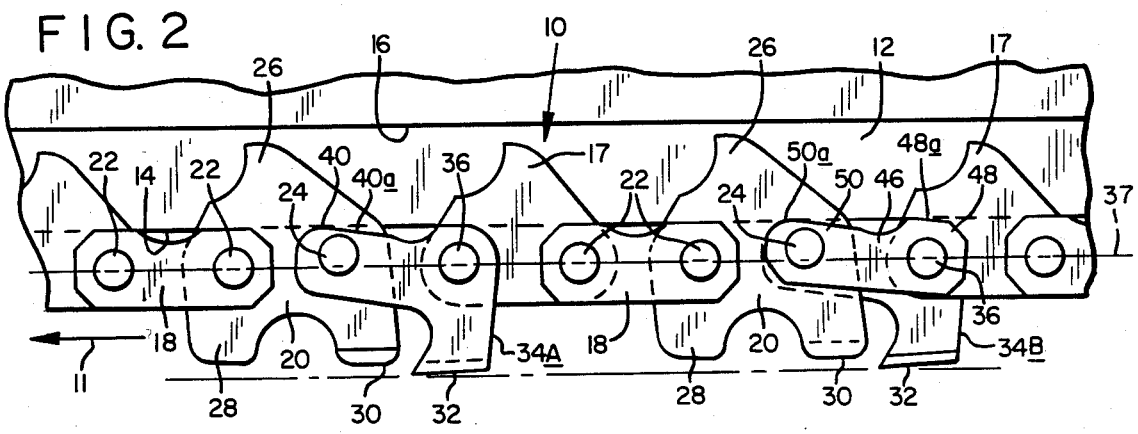
FIG. 2 is a similar view of the saw chain with elements in cutting position.

In FIGS. 1 and 2 a portion of one of the straight portions, or edges, of the bar is illustrated with a side plate portion nearest the viewer removed so that the peripheral chain-receiving groove 12 in the bar is opened up to show how the chain runs in the groove. The outer edge, or rail, of the bar is indicated at 14, and the bottom of the groove is indicated at 16. As illustrated, the bottom of all elements of the chain generally are spaced from the bottom of the groove.

The present invention is concerned primarily with providing additional safety for the user in the regions where the chain runs along the substantially straight portions of the bar as illustrated.

The saw chain includes substantially conventional centermounted drive links, or elements, 17; substantially conventional side links, or tie straps, 18; center-mounted non-cutting safety links, or elements, 20; side-mounted cutter links, or elements, 34A, 34B; and safety side links, or tie straps, 46. The safety links 20 may also be referred to herein as clearing elements, and the cutter links 34A, 34B, may be referred to as cutting tooth elements.

These links are pivotally interconnected by rivets, or pivot pins, indicated generally at 22, 24, and 36, as will be described in greater detail below. When the chain is positioned as illustrated in FIG. 1, normally tensioned, straight, and without added pressure thereon directed toward the bar, the rivets are all substantially aligned on a pivot line 37.

Drive links 17 have sprocket-engaging tang portions which project into and are received in groove 12. Conventional tie straps, or side links, 18 are pivotally connected by rivets 22 to the trailing end of each drive link 17. The under sides of the forward and rear portions of links 18 are adapted to be supported on, and ride along, the outer surfaces of rails 14. As is conventional, links 18 are mounted on opposite sides of drive link 17.

Following tie straps 18 in the sequence and pivotally connected thereto through a rivet 22 is one of safety links, or elements, 20. A drive tang portion 26 of element 20 extends into groove 12 of the bar. At the opposite side of the pivot line from tang 26 and projecting outwardly from the bar are a leading, or first, depth gauge portion, or post, 28 and a trailing, or second, depth gauge portion, or safety member, 30. Portion 30 is also referred to herein as a clearing member. The post and safety member accomplish the usual functions, and also an added novel function is provided by member 30 as will be discussed below.

Figure 3:
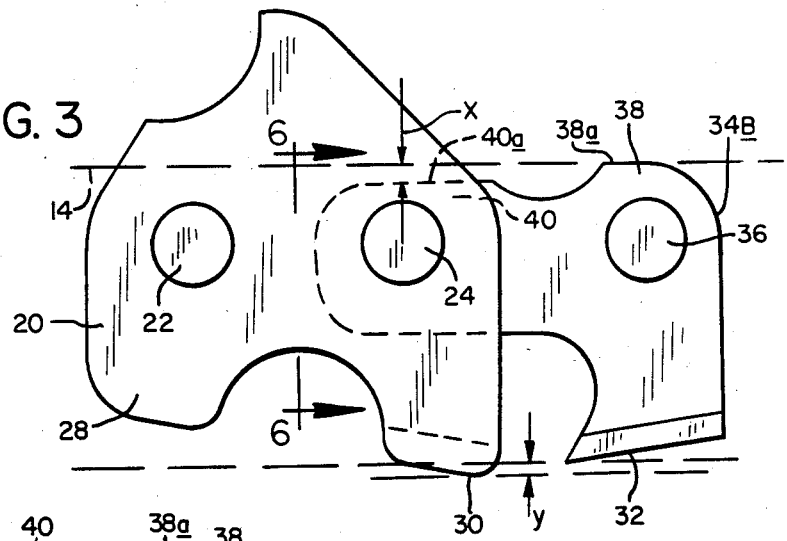
FIG. 3 is an enlarged diagrammatic view of the FIG. 1 condition.
Figure 4:
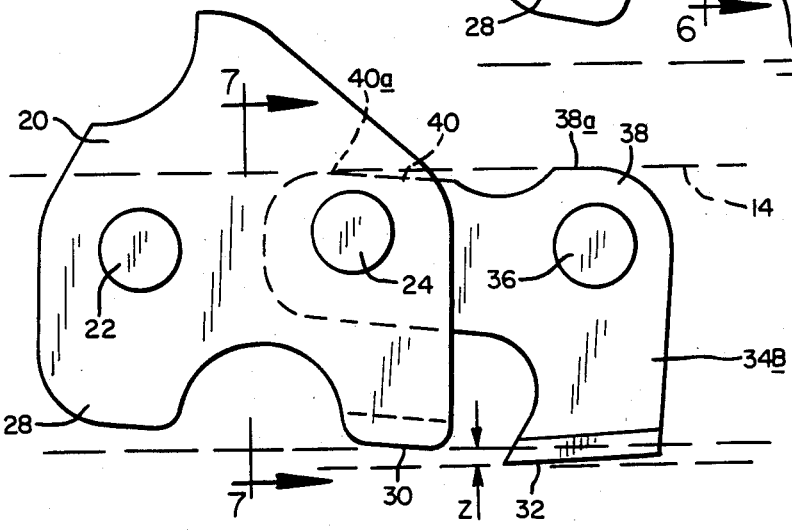
FIG. 4 is an enlarged diagrammatic view of the FIG. 2 condition.

Element 20 is pivotal about the axis of rivet 22, between a first position as illustrated in FIGS. 1 and 3 and a second position shown in FIGS. 2 and 4. When safety member 30 is in its first position it projects outwardly from the bar a distance greater than the outermost portion of cutter link 34, to essentially prevent cutting, and when in its second position it is retracted to a position closer to the bar than the outer cutting portion of cutter link 34 to allow cutting.

Pivotally connected to the trailing portion of one of safety links 20 through a rivet 24, referred to herein also as a front, or forward, pivot connection, are a cutter element, or link, 34B and a safety side link 46. These are positioned on opposite sides of the safety link. Another cutter element 34A and safety side link 46 combination are pivotally connected to and follow another safety link 20 also.

Cutter links 34A, 34B are mirror images of each other, and are disposed on opposite sides of the chain. Cutter link 34A is illustrated positioned in the chain nearest the viewer, and cutter link 34B is positioned on the side opposite the viewer.

Figure 7:
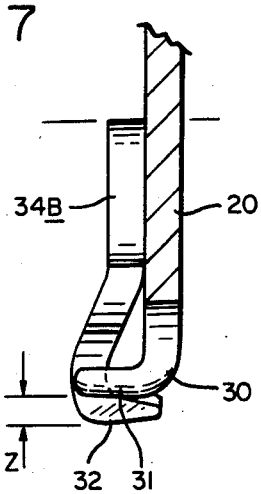

Each cutter link includes a main body portion, or foot, in which bores are provided for receiving rivets 24, 36, and an upstanding rearward portion, or cutter member 32 including a top plate cutter portion. The cutter portion is bent back and over as illustrated in FIG. 7 and, its forward edge is sharpened to provide cutting.

The rear portion 38 of each cutter link has an undersurface 38*a* which is spaced a selected first distance from the pivot line and generally rests on rails 14 of the guide bar when the chain runs therealong and the rivet center lines are substantially aligned. The front portion 40 of the cutter link is shallower, having an undersurface 40*a*, spaced from the pivot line a distance less than the distance of surfaces 38*a*, whereby when the rivet center lines are substantially aligned, as illustrated in FIGS. 1 and 3, undersurface 40*a* is separated by a distance "X" from rails 14 of the bar.

Similarly, the rear portion 48 of each safety side link 46 opposite a cutter link has an undersurface 48*a* constructed to rest on the bar when the rivets are substantially aligned. An undersurface 50*a*, on its forward portion 50 is shallower (shaved somewhat) under rivet 24, whereby it is spaced from rails 14 of the bar, as illustrated in FIG. 1, when the chain is tensioned during operation and the rivet centerlines are substantially aligned.

When the chain is in its normally tensioned state and substantially straight, the rivet center lines are substantially aligned on pivot line 37 and the elements assume what is referred to herein as their safety positions illustrated in FIGS. 1 and 3. In this safety position, the undersides, or undersurfaces, of side links 18 and undersurfaces 38*a*, 48*a* of rear portions of the cutter elements and safety side links are substantially coplaner, or colinear, resting on rails 14 of the bar. The undersides, or undersurfaces, 40*a*, 50*a* of the cutter links and the safety side links are spaced from rails 14 of the guide bar as illustrated in FIGS. 1 and 3. Further, safety member 30 projects outwardly from the bar a distance greater than cutter member 32 by a distance "Y" noted in FIG. 3 to inhibit cutting.

The relief distance "X", under the forward surfaces of the cutters and opposed side links allows elements 20, 34, and 46 to pivot from the safety positions illustrated in FIGS. 1 and 3 to their cutting positions illustrated in FIGS. 2 and 4. In doing so, safety element 20 pivots counterclockwise and elements 34, 46 pivot clockwise, with pivot connection, or rivet, 24 shifting from the pivot line toward the bar. The safety member 30 is retracted to a position below the path of the cutting edge of cutter member 32 as in FIGS. 2 and 4. The distance safety member 30 is retracted below the cutting edge of cutter member 32 is noted at "Z" in FIG. 4. This occurs when a hard object, such as wood, is encountered and pressure is applied to the chain in a direction toward the bar. The chain tension inhibits such retraction at other times, such as when the chain encounters soft substances, such as flesh.

The pivoting or shifting of post 28 and cutter member 32 is so slight as to not affect their respective functions, but safety member 30 is retracted sufficiently to cease protecting against cutting as illustrated in FIGS. 3 and 4.

The sequence of elements in the chain as described is repeated for the length of the chain. It should be noted, that the greater the chain tension, the stronger and more effective is the safety function. The safety member may not actually function to clear the kerf in some instances, but ordinarily advantage is taken of this element to also render it a clearing means.

Figure 5:
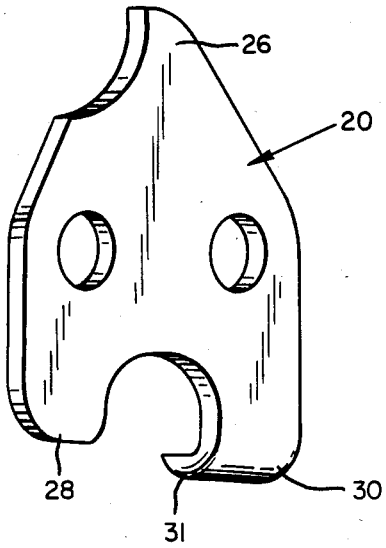
FIG. 5 is a perspective view of a safety element for the chain.
Figure 6:
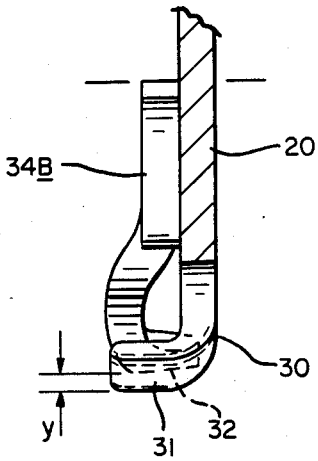
FIGS. 6 and 7 are views taken along the lines 6—6 and 7—7 in FIGS. 3 and 4, respectively.

In FIGS. 5, 6 and 7 wherein the safety member 30 is shown in greater detail, it will be seen that it includes a bent out terminal clearing portion 31, which not only may clear the kerf during cutting, but inhibits cutting by cutter tooth portion 32 for substantially the width of the latter. FIG. 6, taken along lines 6—6 in FIG. 3, illustrates the relative positions of portion 31, and cutter element when in their safety positions, and FIG. 7, taken along the line 7—7 in FIG. 4, illustrates such in their cutting positions.

While a preferred embodiment of the invention has been described herein, it should be apparent to those skilled in the art that variations and modifications may be made without departing from the spirit of the invention.

I claim:

1. A chain for a chain saw including a cutter bar having a periphery about which the chain circulates with a substantially straight portion along which the chain travels, said chain comprising articulated cutting tooth elements and additional non-cutting elements, safety members on the non-cutting elements projecting in the same direction as the cutting teeth and shiftable between two positions while on the substantially straight portion of the bar, one position in which the safety members extend beyond the cutting teeth inhibiting cutting, and a second position in retracted position in which the teeth are allowed to cut, the safety members being normally held in said one position solely by longitudinal tension in the chain to inhibit cutting in the absence of pressure on the chain toward the cutter bar, and pins articulating the elements wherein tension applied to the chain about the cutter bar normally maintains the pins in a single line, but at the same time allows retraction of certain pins upon contact of the chain with a relatively hard substance.

2. A chain for a chain saw having a cutter bar occupying a plane about the periphery of which bar the chain circulates, the bar having a substantially straight portion along which the chain travels, the chain comprising a cutting tooth element, a cutting tooth on said element, a clearing element, a clearing portion on the clearing element, and the elements being articulated by means of a pin, said pin and clearing portion being disposed at substantially right angles to the plane occupied by the cutter bar, the articulation between the cutting tooth element and the clearing element permitting the clearing portion to retract generally toward the bar when pressure is applied thereto in a direction toward the bar to a position closer to the bar than the cutting tooth allowing the cutting tooth to cut, but in the absence of such pressure on the clearing element said clearing portion being maintained by tension of the chain in a position extending beyond the tooth to inhibit cutting.

3. The chain of claim 2, wherein the cutting tooth element is substantially in the form of an L having an upright and a foot, and a clearing element is substantially in the form of an L having an upright and a foot, the feet being articulated by said pin and the clearing portion is located in line with the pin joining the feet of the L's.

4. The combination of a chain saw having a cutter bar with a groove extending peripherally thereof, and a chain comprising articulated drive elements adapted to run in the groove, articulated elements extending outwardly from the groove, cutter members on certain elements and safety members on alteranting elements, said chain being under conventional tension on the bar wherein the safety members extend beyond the cutters in safety position, said elements being forced to move relatively with respect to each other to cause the cutter members to move to cutting position relative to the safety members upon pressure being applied to the chain in a direction inwardly toward the bar, and pins articulating said elements, with certain of said pins being movable toward the bar under such pressure.

5. The combination of claim 4, wherein the elements are substantially L-shaped, and the pins join the L's whereby the L's are adapted to pivot in pairs, one clockwise and the other of the pair counterclockwise.

6. A saw chain for use with a cutter bar having a substantially straight portion on which the chain travels, said chain comprising a plurality of links with pivot connections therebetween, said links bearing a cutter member projecting outwardly a first distance from the bar and a safety member leading said cutter member, said safety member being mounted for shifting between a first position with an outer portion thereof extending outwardly from the bar a distance greater than said first distance to inhibit cutting when said chain is normally tensioned and traveling on the substantially straight portion of the bar, and a second position retracted toward the bar to a distance less than said first distance to permit cutting when pressure is applied thereto in a direction toward the bar.

7. The saw chain of claim 6 wherein said links have undersurfaces adapted to be supported on a peripheral portion of the cutter bar, the cutter member projects outwardly from a pivot connection overlying a link undersurface which engages the bar as it travels along the substantially straight portion thereof, and the safety member is connected to and projects outwardly from a pivot connection which overlies a link undersurface which is spaced outwardly-from the peripheral portion of the bar when the chain is normally tensioned and traveling on a substantially straight portion of the bar without pressure applied thereto in a direction toward the bar.

8. The saw chain of claim 7 wherein one of said links is a cutter link which has opposed forward and rearward ends, forward and rearward pivot connections, and undersurfaces beneath each said pivot connection, said undersurfaces being so positioned on the link that when the chain is normally tensioned and traveling on said substantially straight portion of the bar, the undersurface of the rear portion of the cutter link rests against the cutter bar and the undersurface of the forward portion thereof is spaced from the bar.

9. The saw chain of claim 8 which said cutter link is a side link in the chain, a center link is pivotally connected at its trailing end to the forward pivot connection of said cutter link, said safety member is mounted on said center link and projects outwardly substantially above said front pivot connection, and said cutter member projects outwardly substantially above said rear pivot connection.

10. A saw chain comprising a plurality of links joined by pivot connections which are substantially aligned along a pivot line when the chain is normally tensioned and held substantially straight, said links bearing a cutter member projecting outwardly a first distance from said pivot line and a safety member leading said cutter member, said safety member being shiftable between a first position with an outer portion thereof extending outwardly from said pivot line a distance greater than said first distance to inhibit cutting when the chain is normally tensioned and no external pressure is applied thereto in a direction toward the pivot line and a second position retracted toward the pivot line wherein said safety member extends from the pivot line a distance less than said first distance to permit cutting when pressure is applied thereto in a direction toward the pivot line.

11. The saw chain of claim 10, wherein a link has a cutter bar-engaging surface on the opposite side of the pivot line from said cutter member which surface is disposed at a second distance from said pivot line, and another cutter bar-engaging surface on the opposite side of the pivot line from said safety member which other surface is disposed closer to said pivot line than said second distance.

12. The saw chain of claim 10, wherein a link in the chain is a cutter link having spaced front and rear pivot connections, and front and rear cutter bar-engaging surfaces underlying said pivot connections, respectively, said front surface being disposed closer to said pivot line than said rear surface, said cutter member being operatively connected to and projecting outwardly from said rear pivot connection, and said safety member being operatively connected to and projecting outwardly from said front pivot connection.

13. The saw chain of claim 12, wherein the cutter link is a side link in the chain, a center link is pivotally connected at its trailing end to the front pivot connection of said cutter link, and said safety member is mounted on said center link and projects outwardly substantially above said front pivot connection.

14. A saw chain comprising a plurality of links joined by pivot connections, said links bearing a cutter member which projects outwardly from said pivot connections a first distance and a safety member leading said cutter member, said safety member mounted in said chain to extend outwardly beyond said first distance to inhibit cutting when the chain is normally tensioned and running in a substantially straight line without pressure applied thereto in a direction toward said pivot connections, and being retractable to a position spaced inwardly toward said pivot connections from said first distance to expose the cutter member permitting cutting when pressure is applied to said safety member in a direction toward said pivot connections.

15. A chain for a chain saw having a cutter bar with a substantially straight portion along which the chain travels, said chain comprising in-line articulated cutter elements having cutting teeth thereon, additional elements in the line of the cutting teeth having safety members thereon leading said cutting teeth during operation, said safety members being shiftable between first and second positions when the chain travels along the substantially straight portion of the bar, a safety member when in said first position projecting outwardly beyond a cutting tooth to prevent it from cutting and when in its second position the safety member is retracted relative to the cutting tooth to allow cutting, a safety member being automatically retracted to place the safety member in said second position by contact with a relatively hard material, such as wood, and wherein, in the absence of contact with such material is automatically moved into the first position through longitudinal tension applied to the chain, and pivot pins mounting said cutter elements and the additional elements, said pivot pins being normally positioned in line when the chain is under longitudinal tension, the additional elements being pivotable to retract the safety members upon such contact.

* * * * *